US009983532B2

(12) United States Patent
Otsuka et al.

(10) Patent No.: US 9,983,532 B2
(45) Date of Patent: May 29, 2018

(54) IMAGE FORMING APPARATUS WITH DENSITY MEASURING PORTION

(71) Applicant: Sharp Kabushiki Kaisha, Osaka (JP)

(72) Inventors: Masayuki Otsuka, Osaka (JP); Ginga Nakamura, Osaka (JP); Takashi Kitagawa, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days. days.

(21) Appl. No.: 15/244,562

(22) Filed: Aug. 23, 2016

(65) Prior Publication Data

US 2017/0075274 A1 Mar. 16, 2017

(30) Foreign Application Priority Data

Sep. 15, 2015 (JP) ..... 2015-181761

(51) Int. Cl.
*G03G 15/00* (2006.01)

(52) U.S. Cl.
CPC ..... *G03G 15/5058* (2013.01)

(58) Field of Classification Search
CPC ..... G03G 15/165
USPC ..... 399/49, 74, 164; 206/316.1
See application file for complete search history.

(56) References Cited

U.S. PATENT DOCUMENTS

2007/0098423 A1* 5/2007 Hirayama ..... G03G 15/0131 399/49

FOREIGN PATENT DOCUMENTS

| | | | |
|---|---|---|---|
| JP | 2002-182494 | A | 6/2002 |
| JP | 2003-248350 | A | 9/2003 |
| JP | 2007-121952 | A | 5/2007 |
| JP | 2009-014956 | A | 1/2009 |

* cited by examiner

*Primary Examiner* — Walter L Lindsay, Jr.
*Assistant Examiner* — Ruth Labombard
(74) *Attorney, Agent, or Firm* — Renner, Otto, Boisselle & Sklar, LLP

(57) ABSTRACT

An image forming apparatus includes: a roller arranged in a position between a drive roller and an idle roller and downstream from the drive roller in a rotation direction of an intermediate transfer belt while pressing an outer surface of the belt; and a density measuring portion arranged between the drive roller and the roller applying pressure. The density measuring portion optically detects the density of a test patch formed on the outer surface and in a given position of a width direction of the belt. The density measuring portion includes: an optical sensor provided above the outer surface of the belt; and a support member abutting on an inner surface of the belt in a position in which the support member faces the optical sensor across the belt in the rotation direction.

3 Claims, 3 Drawing Sheets

IMAGE FORMING APPARATUS WITH DENSITY MEASURING PORTION

CROSS REFERENCE

This Nonprovisional application claims priority under 35 U.S.C. § 119(a) on Patent Application No. 2015-181761 filed in Japan on Sep. 15, 2015, the entire contents of which are hereby incorporated by reference.

BACKGROUND OF THE INVENTION

1. Field of the Invention

This invention relates to an image forming apparatus including a transfer belt that rotates between rollers juxtaposed to each other.

2. Description of the Related Art

A developer used in an image forming apparatus may be subject to characteristic change responsive to change in environment such as temperature or humidity, or characteristic change resulting from temporal change. Change in the characteristics of the developer changes a finished state of an image obtained by charging and exposure of a photoreceptor drum and development. Hence, processes including image quality adjustment and gradation correction have conventionally been performed. According to these processes, an image of a test pattern is formed on a transfer belt, the density of the resultant image is measured by an optical sensor from above the transfer belt, and an image quality is adjusted and gradation is corrected based on a result of the measurement. In this way, change in the finished state of the image is suppressed. To measure the density of the test pattern with high accuracy, an abutting member is arranged on the rear side of a measurement point of the transfer belt.

Japanese published unexamined patent application No. 2007-121952 describes an intermediate transfer belt including a rectangular support member functioning as rear abutting portion in a point of measurement by an optical sensor. The support member has a gentle flat surface, or a contact surface determined by a part of its rear surface except grooves of 0.5 mm arranged separately in the width direction of the intermediate transfer belt. This suppresses output fluctuation of the sensor due to vibration, thereby obtaining stable output.

Japanese published unexamined patent application No. 2009-14956 describes an image forming apparatus where a reading sensor is arranged on an outer side of an intermediate transfer belt and a low-friction soft member is arranged in a position in which the low-friction soft member faces the reading sensor across the intermediate transfer belt in the rotation direction of the belt. The reading sensor and the low-friction soft member are each provided in two positions of the width direction of the belt. Vibration of the intermediate transfer belt is suppressed by making the low-friction soft member apply bias toward the belt.

Japanese published unexamined patent application No 2003-248350 describes an image forming apparatus where a toner image detection sensor and a plate-like abutting member are arranged to face each other across an electrostatic conveyor belt. The abutting member is provided on the rear side of the electrostatic conveyor belt. In this way, even if belt tension is changed, density can still be detected stably.

Japanese published unexamined patent application No 2002-182494 describes an image forming apparatus where a projecting curved surface portion of a crease suppressing member formed by curving a sheet-like member is provided in the vicinity of a toner heating portion on the rotation of an intermediate transfer belt to abut on the intermediate transfer belt over the width direction of the belt. In this way, disturbance of a toner image due to a crease in the belt caused by heating is suppressed.

In the structure described in each of Japanese published unexamined patent application Nos. 2007-121952, 2009-14956, and 2003-248350, an endless transfer belt is stretched between rotation rollers at opposite marginal portions and a sensor for reading an image density in an appropriate position on the rotation path of the belt is provided externally to the belt. This requires space for the sensor outside the rotation path of the transfer belt, resulting in corresponding size increase. Additionally, the sensor is arranged in a position corresponding to the center of an abutting member or upstream from the abutting member in the rotation direction of the belt. Hence, influence caused by vibration of the belt cannot be removed sufficiently. Japanese published unexamined patent application No. 2002-182494 does not describe an abutting member for suppressing disturbance of detection of an image density by sensor.

This invention has been made in view of the aforementioned problems. This invention is intended to provide an image forming apparatus that maintains constant detection accuracy while contributing to saving of space for an optical sensor for detecting a toner density in a test patch.

SUMMARY OF THE INVENTION

This invention is intended for an image forming apparatus including: a first roller, a second roller juxtaposed to the first roller, an endless transfer belt that rotates between the first roller and the second roller; a third roller arranged in a position parallel to the first roller and the second roller and downstream from the first roller in a rotation direction of the transfer belt while pressing an outer surface of the transfer belt; and a density measuring portion arranged between the first roller and the third roller. The density measuring portion optically detects the density of a test patch formed on the outer surface of the transfer belt and in a given position of a with direction of the transfer belt. The density measuring portion includes: an optical sensor provided between the first roller and the third roller and above the outer surface of the transfer belt, the optical sensor making measurement in a position that corresponds to a pathway of the test patch in the width direction formed on the transfer belt; and a support member abutting on an inner surface of the transfer belt in position in which the support member faces the optical sensor across the transfer belt in the rotation direction.

According to this invention, the presence of the third roller makes the transfer belt rotates along a path curved toward the direction of the inner surface (rear surface) of the transfer belt. Further, the density measuring portion arranged between the third roller and the first roller. By the presence of the support member of the density measuring portion arranged to face the optical sensor of the density measuring portion across the transfer belt, vibration of the rotating transfer belt is suppressed to ensure accuracy of detecting toner density in the test patch formed on the outer surface (front surface) of the transfer belt. Further, the presence of the third roller warps the transfer belt toward its inner surface. This makes the optical sensor make measurement in a position closer to the inner surface of the transfer belt. Thus, the optical sensor can be arranged closer to the transfer belt, thereby contributing to space saving.

This invention is capable of maintaining constant detection accuracy while contributing to saving of space for an optical sensor for detecting a toner density in a test patch.

DETAILED DESCRIPTION OF THE PREFERRED EMBODIMENTS

Figure 1:
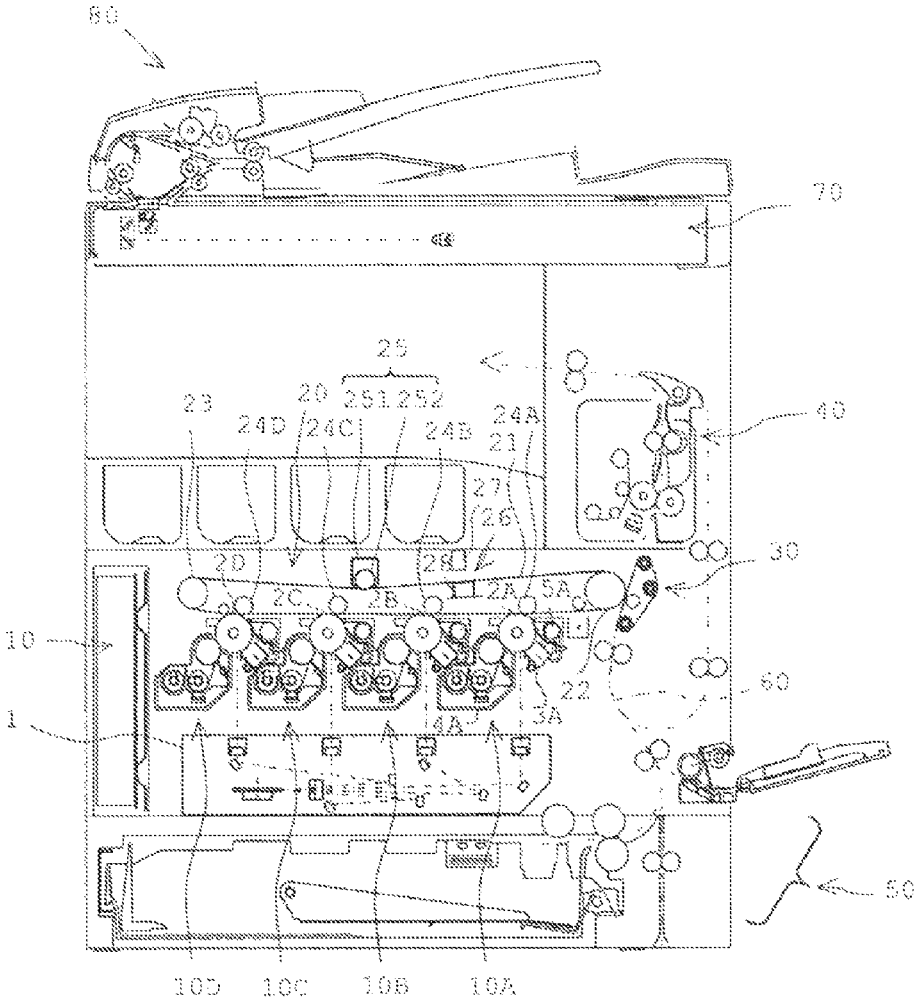
FIG. 1 is a side sectional view schematically showing the structure of an image forming apparatus according to this invention.

As shown in FIG. 1, an image forming apparatus includes an image forming portion 10, an intermediate transfer portion 20, a secondary transfer portion 30, a fixing portion 40, a sheet feed portion 50, a sheet conveyor path 60, a reading portion 70 for reading a document image, and an automatic document feeder 80. The image forming apparatus prints image data read from a document onto a recording sheet.

The image forming portion 10 includes a laser scanning unit 1, and image forming portions 10A to 10D prepared for the corresponding colors and including comparable structures. The laser scanning unit 1 includes a casing. The casing houses a laser element and an optical component such as a polygon mirror for laser light scanning that are prepared for each color. The laser scanning unit 1 exposes and scans surface of each of photoreceptor drums 2A to 2D of the image forming portions 10A to 10D respectively in the axis direction (main scanning direction) of each photoreceptor drum with laser light modulated in corresponding relationship with image data of each color resulting from conversion, thereby forming an electrostatic latent image of each color. The image forming portion 10A, which will be described as a representative, includes the photoreceptor drum 2A. The image forming portion 10A includes a charger 3A, a developing unit 4A, and a cleaning portion 5A arranged in the direction of rotation of the photoreceptor drum 2A (sub-scanning direction) to surround the photoreceptor drum 2A.

The intermediate transfer portion 20 includes an endless intermediate transfer belt 21, a drive roller 22, an idle roller 23, primary transfer rollers 24A to 24D, and a cleaning portion 25. The intermediate transfer portion 20 transfers a toner image of each color formed on the circumferential surface of corresponding one of the photoreceptor drums 2A to 2D primarily onto a surface of the rotating intermediate transfer belt 21. The secondary transfer portion 30 transfers the toner image on the surface of the intermediate transfer belt 21 secondarily onto a recording sheet. The fixing portion 40 heats and fixes the toner image transferred onto the recording sheet and outputs the recording sheet to an output tray. The sheet feed portion 50 includes a sheet feed cassette and a manual feed tray and feeds a selected recording sheet from a corresponding sheet feed cassette to the sheet conveyor path 60.

The cleaning portion 25 of the intermediate transfer portion 20 is arranged to abut on the belt surface of the intermediate transfer belt 21 from above (from outside) on rotation path along which the intermediate transfer belt 21 rotates from a side adjacent to the drive roller 22 toward the idle roller 23. Referring to FIG. 1, the cleaning portion 25 is arranged almost midway between the drive roller 22 and the idle roller 23. The cleaning portion 25 is a publicly-known cleaning portion. The cleaning portion 25 at least includes an elongated box body 251 extending over the width direction of the surface of the intermediate transfer belt 21, and a roller 252 for cleaning in the box body 251 made of a sponge material, for example, and supported at opposite sides of the longitudinal direction. As is publicly known, residual toner collected by the cleaning is recovered for example into a recovery container through a recovery mechanism not shown in the drawings. The roller 252 of the cleaning portion 25 is arranged to press the intermediate transfer belt 21. As a result, the upper half portion of the intermediate transfer belt 21 on the rotation path is curved downward from opposite sides of the rotation direction toward a point pressed with the roller 252.

A density measuring portion 26 is arranged on the upper half portion of the intermediate transfer belt 21 on the rotation path and between the drive roller 22 and the idle roller 23. The density measuring portion 26 includes an optical sensor 27 arranged externally to (above) the intermediate transfer belt 21, and a support member 28 arranged in a position facing the optical sensor 27 across the intermediate transfer belt 21.

Figure 2A:
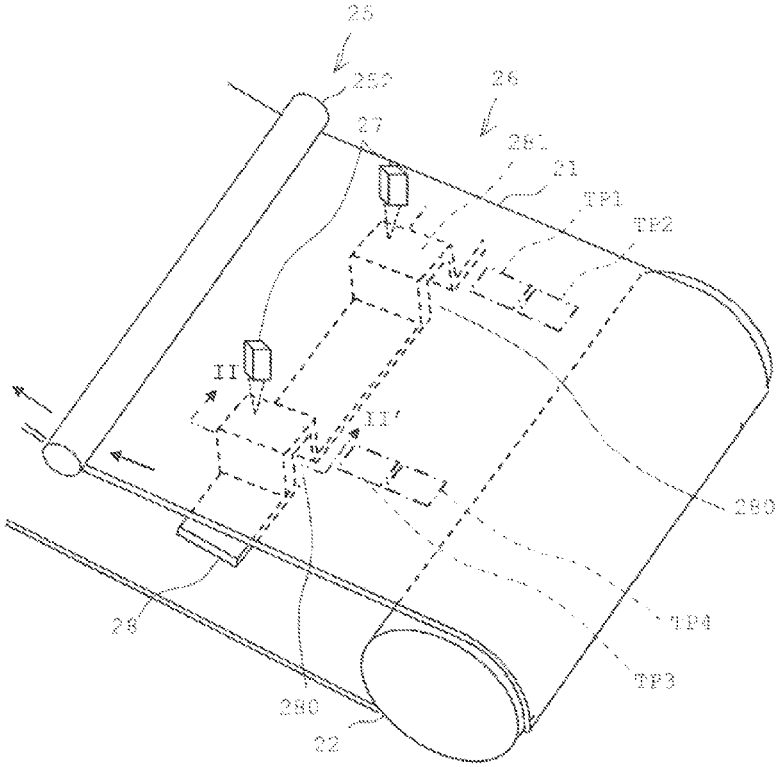
FIG. 2A is a partially enlarged perspective view showing a density measuring portion according to a first embodiment.
Figure 2B:
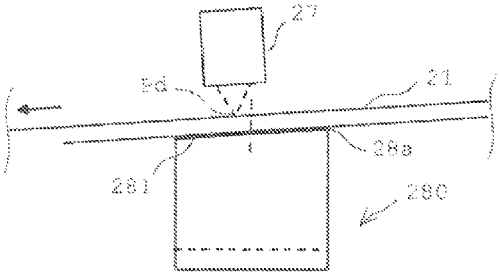
FIG. 2B is a view taken along an arrow line II-II' of FIG. 2A.

Referring to FIGS. 2A and 2B showing the density measuring portion 26 according to a first embodiment, the optical sensor 27 has a box body of a given size. The optical sensor 27 includes a light-emitting element that emits light from above the intermediate transfer belt 21 in a direction of a normal to the intermediate transfer belt 21 toward the upper surface of the intermediate transfer belt 21. The optical sensor 27 further includes a regular reflection light-receiving element and an irregular reflection light-receiving element. The regular reflection light-receiving element receives light resulting from regular reflection on each of test patches TP1 to TP4 that are toner images of corresponding colors generated in an image quality adjustment mode or a gradation correction mode, and outputs a voltage responsive to the quantity of the received light. The irregular reflection light-receiving element receives light resulting from irregular reflection on each of the test patches TP1 to TP4 and outputs a voltage responsive to the quantity of the received light. In this embodiment, the optical sensor 27 includes two optical sensors 27 arranged in two places corresponding to positions in the width direction in which the test patches TP1 to TP4 are generated.

Regarding the respective toner colors of the test patches TP1 to TP4, the test patch 191 is in black and the test patches TP2 to TP4 are in yellow, cyan, and magenta respectively, for example. As for the black color, the density of the test patch TP1 is generally evaluated based on the intensity of light resulting from regular reflection. As for the other colors, the respective densities of the test patches TP2 to TP4 are generally evaluated based on the respective intensities of light resulting from irregular reflection.

The support member 28 is formed of a plate member made of metal or resin, for example, that extends long in the width direction of the intermediate transfer belt 21 while having a band-like shape of a required width. The support member 28 includes an abutting portion 280 formed in a place facing the optical sensor 27 across the intermediate transfer belt 21. The abutting portion 280 includes a crest portion 281 bent upward into a rectangular shape as viewed in the rotation direction, for example. As shown in FIG. 2B, the crest portion 281 has a tilt agreeing with a tilt of the intermediate transfer belt 21 in the rotation direction (indicated by an arrow in FIG. 2B). The crest portion 281 includes a low-friction material 28*a* provided by means of laying, affixation, or surface coating, for example. Thus, abutting contact of the intermediate transfer belt 21 with the crest portion 281 suppresses vibration of the intermediate transfer belt 21 occurring in response to the rotation of the intermediate transfer belt 21, thereby ensuring accuracy of density measurement by the optical sensor 27.

A point of measurement Pd in the rotation direction by the optical sensor 27 is set to be downstream from an intermediate position of the crest portion 281 in the rotation direction (the point of measurement Pd is on the left side of the intermediate position in FIG. 2B). By doing so, a density is measured while vibration of the rotating intermediate transfer belt 21 is suppressed, thereby ensuring measurement accuracy at a higher level. Additionally, the optical sensor 27 is arranged above the intermediate transfer belt 21 in a place where the intermediate transfer belt 21 is tilted downward, so that the position of the optical sensor 27 can be lowered. This allows corresponding space saving, thereby contributing to size reduction of the apparatus. The support member 28 includes the abutting portion 280 formed in a place corresponding to the position of the optical sensor 27. Meanwhile, the upper surface of the support member 28 may be flush over the entire width direction of the intermediate transfer belt 21. This can still achieve the aforementioned suppression of vibration or contribute to the aforementioned space saving.

Figure 3A:
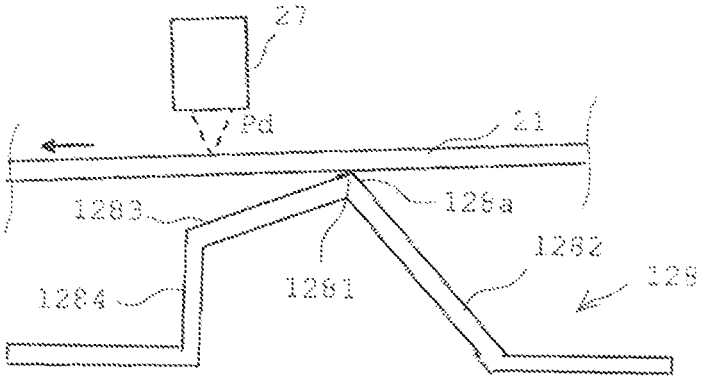
FIG. 3A shows the structure of a density measuring portion in a side view according to a second embodiment.
Figure 3B:
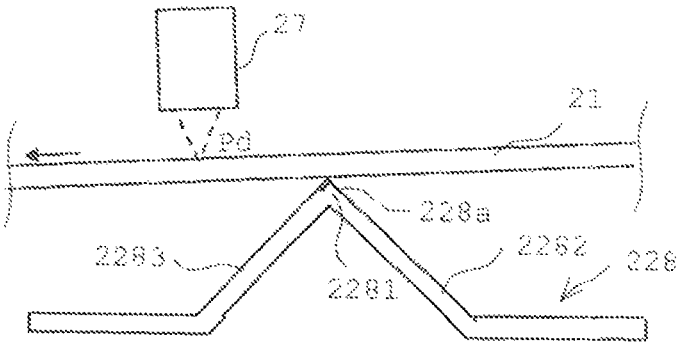
FIG. 3B shows the structure of a density measuring portion in a side view according to a third embodiment.

In FIGS. 3A and 3B, a support member has a constant shape in its longitudinal direction (in the width direction of an intermediate transfer belt). Specifically, the support member is allowed to have a constant shape over the entire width direction by reducing a contact area between the support member and the intermediate transfer belt.

A support member 128 shown as a second embodiment in FIG. 3A includes a crest portion 1281 like a projection formed in the center of the support member 128 as viewed in the width direction. The crest portion 1281 is formed of an upward wall portion 1282 having an upward tilt, a downward wall portion 1283 having a downward tilt, and a vertical rear end wall portion 1284 that are arranged in this order as viewed from an upstream side of the rotation direction. The crest portion 1281 includes a ridge extending in the width direction of the intermediate transfer belt 21. The crest portion 1281 includes a low-friction material 128*a* provided by means of affixation, for example. The point of measurement Pd by the optical sensor 27 is set within a range of the downward wall portion 1283 to e downstream from the crest portion 1281 in the rotation direction. The second embodiment achieves working effect comparable to that achieved by the first embodiment.

A support member 228 shown as a third embodiment in FIG. 3B includes a crest portion 2281 like a projection formed in the center of the support member 228 as viewed in the width direction. The crest portion 2281 is formed of an upward wall portion 2282 having an upward tilt and a downward wall portion 2283 having a downward tilt that are arranged in this order as viewed from an upstream side of the rotation direction. The crest portion 2281 includes a ridge extending in the width direction of the intermediate transfer belt 21. The crest portion 2281 includes a low-friction material 228*a* provided by means of affixation, for example. The point of measurement Pd by the optical sensor 27 is set within a range of the downward wall portion 2283 to be downstream from the crest portion 2281 in the rotation direction. The third embodiment also achieves working effect comparable to that achieved by the first embodiment.

In each of the second and third embodiments, an abutting portion may be formed of a portion including the crest portion 1281 or 2281 provided only in a position facing the optical sensor 27.

It should be noted that the foregoing description of the embodiments is in all aspects illustrative and not restrictive. The scope of this invention is defined by the appended claims rather than by the embodiments described above. All changes that fall within a meaning and a range equivalent to the scope of the claims are therefore intended to be embraced by the claims.

What is claimed is:

1. A toner image forming apparatus comprising:

a first roller;

a second roller juxtaposed to the first roller;

an endless transfer belt stretched rotatably between the first roller and the second roller;

a third roller arranged in a position parallel to the first roller and the second roller and downstream from the first roller in a rotation direction of the transfer belt while pressing an outer surface of the transfer belt; and a density measuring portion arranged between the first roller and the third roller, the density measuring portion optically detecting a toner density of a test patch which is a toner image formed on the outer surface of the transfer belt and in a given position of a width direction of the transfer belt, wherein the density measuring portion comprises:

an optical sensor provided between the first roller and the third roller and above the outer surface of the transfer belt, the optical sensor making measurement in a position that corresponds to a pathway of the test patch in the width direction formed on the transfer belt; and a support member abutting on an inner surface of the transfer belt in a position in which the support member faces the optical sensor across the transfer belt in the rotation direction, the support member including a ridge extending parallel to the width direction of the transfer belt and abutting on the transfer belt at the ridge.

2. The toner image forming apparatus according to claim 1, wherein the optical sensor is arranged downstream from a place of the abutment of the support member on the transfer belt in the rotation direction.

3. The toner image forming apparatus according to claim 1, wherein the support member includes a low-friction material provided in a place where the support member abuts on the transfer belt.

* * * * *